US007080442B2

(12) United States Patent
Kawamura et al.

(10) Patent No.: US 7,080,442 B2
(45) Date of Patent: Jul. 25, 2006

(54) MANUFACTURING METHOD OF ACOUSTIC SENSOR

(75) Inventors: Takao Kawamura, Sakai (JP); Yoshiaki Ohbayashi, Nara (JP); Mamoru Yasuda, Yao (JP)

(73) Assignee: Hosiden Electronics Co., Ltd., Osaka (JP)

( * ) Notice: Subject to any disclaimer, the term of this patent is extended or adjusted under 35 U.S.C. 154(b) by 221 days.

(21) Appl. No.: 10/274,198

(22) Filed: Oct. 21, 2002

(65) Prior Publication Data

US 2003/0035558 A1 Feb. 20, 2003

Related U.S. Application Data

(62) Division of application No. 09/145,293, filed on Sep. 2, 1998, now abandoned.

(30) Foreign Application Priority Data

Sep. 3, 1997 (JP) ..... 9-255947
Jun. 24, 1998 (JP) ..... 10-194994

(51) Int. Cl.
*H04R 31/00* (2006.01)

(52) U.S. Cl. ..... 29/594; 29/417; 29/592.1; 29/609.1; 181/171; 181/172; 216/65; 156/89.11; 156/89.12; 381/173; 381/174; 381/175; 381/396; 381/398; 367/170; 367/171; 367/181; 367/140; 367/141

(58) Field of Classification Search ..... 29/417, 29/592.1, 594, 609.1; 181/171, 172; 216/65; 156/89.11, 89.12; 381/173–175, 396, 398; 367/170, 171, 181, 140, 141

See application file for complete search history.

(56) References Cited

U.S. PATENT DOCUMENTS 4,302,633 A * 11/1981 Tamamura et al. ..... 307/400

(Continued)

FOREIGN PATENT DOCUMENTS

DE 43 29 993 A1 3/1995

(Continued)

OTHER PUBLICATIONS

"Assessment of measuring conditions with the pulse electro-acoustic system adapted to work under electronic irradiation"; Griseri, V.;Fukunaga, K.;Maeno, T.;Laurent, C.;Payan, D.;Levy, L.; Electrical Insulation and Dielectric Phenomena, Oct. 19-22, 2003.*

*Primary Examiner*—Paul D. Kim
(74) *Attorney, Agent, or Firm*—Arent Fox, PLLC.

(57) ABSTRACT

The present invention relates to a semiconductor electret condenser microphone capable of being reduced in size and including an acoustic sensor 100 and a case 200 for accommodating the acoustic sensor 100, the acoustic sensor 100 has a semiconductor chip 110 forming necessary electronic circuits 111A to 111C, and opening a through hole 112 away from the electronic circuits 111A to 111C, an electrode layer 120 formed on the surface of the semiconductor chip 110 away from the through hole 112, an electret member 130 laminated away from part of the electrode layer 120 and through hole 112, and a diaphragm 140 provided with a spacing 160 to the electret member 130, in which the electrode layer 120 exposed from the electret member 130 is connected to the electrode 111*a* of the electronic circuit 111A through the case 200 (FIG. 6).

2 Claims, 10 Drawing Sheets

U.S. PATENT DOCUMENTS

| | | | | | |
|---|---|---|---|---|---|
| 4,443,666 | A | | 4/1984 | Cote | |
| 4,764,244 | A | * | 8/1988 | Chitty et al. | 216/20 |
| 4,993,072 | A | | 2/1991 | Murphy | |
| 5,056,369 | A | * | 10/1991 | Tamai et al. | 73/718 |
| 5,101,543 | A | * | 4/1992 | Cote et al. | 29/25.41 |
| 5,208,789 | A | | 5/1993 | Ling | |

FOREIGN PATENT DOCUMENTS

| | | | |
|---|---|---|---|
| JP | 54-118283 | | 9/1979 |
| JP | 55-102295 | | 7/1980 |
| JP | 57-148500 | | 9/1982 |
| JP | 59-69600 | | 5/1984 |
| JP | 63208735 A | * | 8/1988 |

* cited by examiner (A)

(B)

MANUFACTURING METHOD OF ACOUSTIC SENSOR

CROSS-REFERENCES TO RELATED APPLICATIONS

This application is a divisional application of U.S. application Ser. No. 09/145,293, filed on Sep. 2, 1998, now abandoned. The disclosure of the prior application is hereby incorporated by reference herein in its entirety.

BACKGROUND OF THE INVENTION

1. Field of the Invention

The present invention relates to an acoustic sensor, a manufacturing method for the acoustic sensor, and a semiconductor electret condenser microphone using the acoustic sensor.

2. Description of the Related Art

The electret condenser microphone is widely used in mobile telephones because it is easily reduced in size. An example of an art-known electret condenser microphone is shown in FIG. 10. This electret condenser microphone includes a case 1, a diaphragm 7 provided in this case 1, an electret film 5 (formed in the case 1) disposed opposite to this diaphragm 7, and an amplifying element 9 for amplifying the change of voltage due to change of electrostatic capacity of the capacitor composed of the diaphragm 7 and electret film 5. The amplifying element 9 is incorporated in the case 1.

For a conventional electret condenser microphone, the components for the amplifying element and the capacitor are completely separate, and there is a limit to reduction of sizes.

For this kind of electret condenser microphone, in particular, since an independent FET was used for impedance conversion, reduction of size was difficult.

The present invention was designed in the light of the problems associated with the prior art, and an object of the invention was to develop an acoustic sensor capable of substantially reducing the size of the semiconductor electret condenser microphone, a manufacturing method for the acoustic sensor, and a semiconductor electret condenser microphone using the acoustic sensor.

BRIEF SUMMARY OF THE INVENTION

The acoustic sensor of the invention includes a semiconductor chip forming a necessary electronic circuit, an electrode layer formed on the surface of this semiconductor chip, an electret layer formed on the surface of this electrode layer, and a diaphragm disposed with a spacing to this electret layer.

Moreover, the acoustic sensor of the invention includes a semiconductor chip forming a necessary electronic circuit, and opening a through hole away from the electronic circuit, an electrode layer formed on the surface of this semiconductor chip away from the through hole, an electret film laminated away from part of this electrode film and the through hole, and a diaphragm disposed with a spacing to this electret film.

The manufacturing method of acoustic sensor of the invention includes a step of forming a necessary electronic circuit on a wafer, and opening a through hole away from the electronic circuit, a step of forming an electrode layer on the wafer surface away from the through hole, a step of laminating an electret film away from part of the electrode layer and the through hole, a step of laminating a spacer on the electret film, a step of forming a diaphragm with a spacing to the electret film on the spacer, and a step of dividing into individual sensors.

Incidentally, the step of opening the through hole may be also done after the step of laminating the spacer on the electret film.

The semiconductor electret condenser microphone of the Invention includes the acoustic sensor, and a case for accommodating this acoustic sensor, in which the electrode layer exposed from the electret film is connected to the electrode of the electronic circuit through the case.

Figure 1:
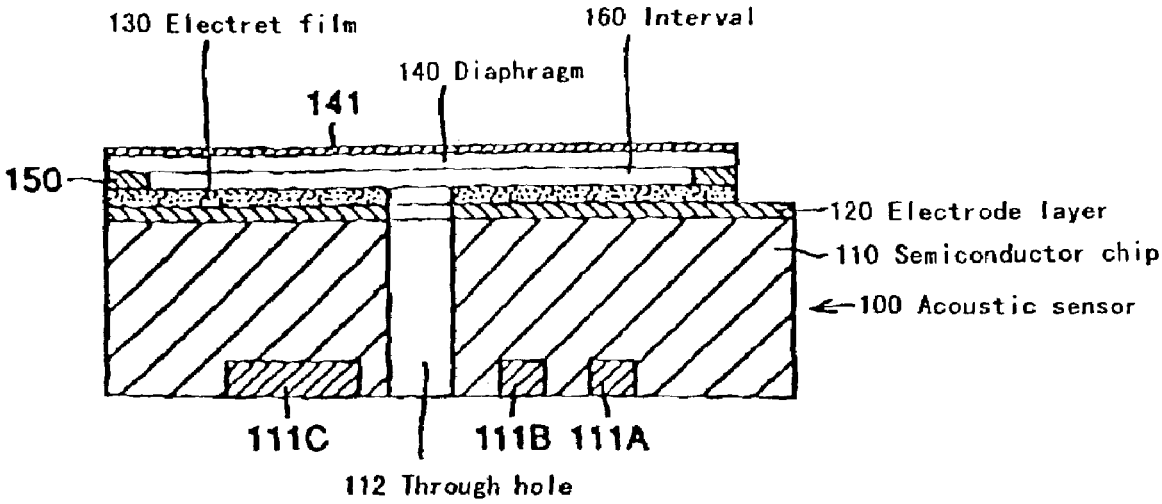
FIG. 1 is a schematic sectional view of an embodiment for an acoustic sensor of the invention.

Reference numerals used throughout the Figures and for this application are as follows:

100 Acoustic sensor
110 Semiconductor chip
112 Through hole
120 Electrode layer
130 Electret film
140 Diaphragm
160 Interval

DETAILED DESCRIPTION OF THE INVENTION

An embodiment of the invention is an acoustic sensor 100 which includes a semiconductor chip 110 forming an FET circuit 111A, a response gain control circuit 111B, an amplifying circuit 111C and others as necessary electronic circuits, and opening a through hole 112 away from the FET circuit 111A and others, an electret film 130 laminated away from the gate electrode 111*a* of the FET circuit 111A and the through hole 112 formed in the semiconductor chip 110, and a diaphragm 140 disposed with a spacing to this electret film 130.

The construction of the acoustic sensor 100 is described below according to its manufacturing method.

A multiplicity of the acoustic sensors 100 are formed simultaneously on a wafer 500.

Figure 2:
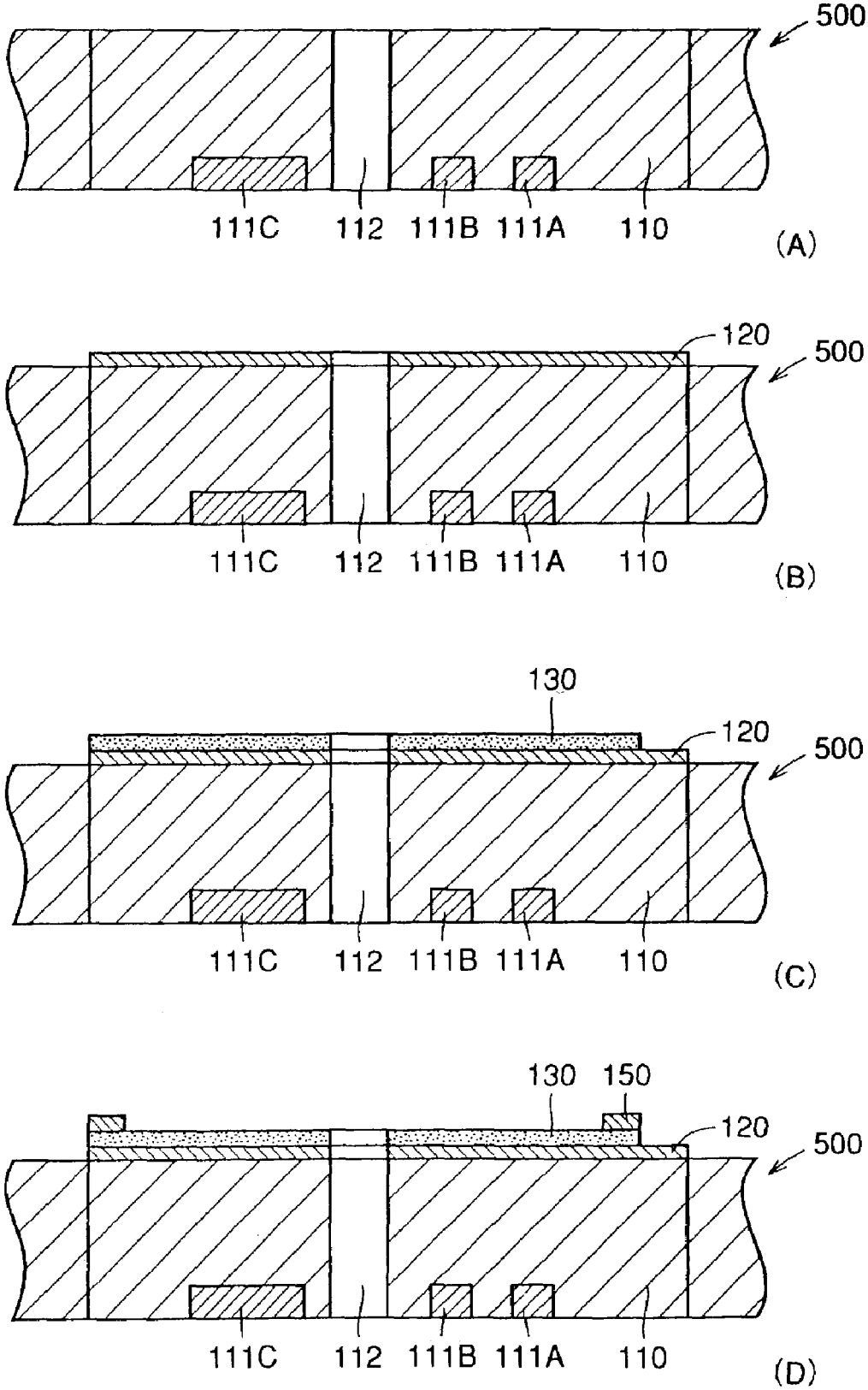
FIG. 2 is a schematic sectional view showing each step for an embodiment of a manufacturing method for the acoustic sensor of the invention.

A plurality of through holes 112 are opened in the wafer 500 (see FIG. 2 (A)). The through hole 112 is opened in the center of one acoustic sensor 100 by ultrasonic processing or laser processing. The diameter of the through hole 112 is preferably 0.5 mm or less.

Figure 5:
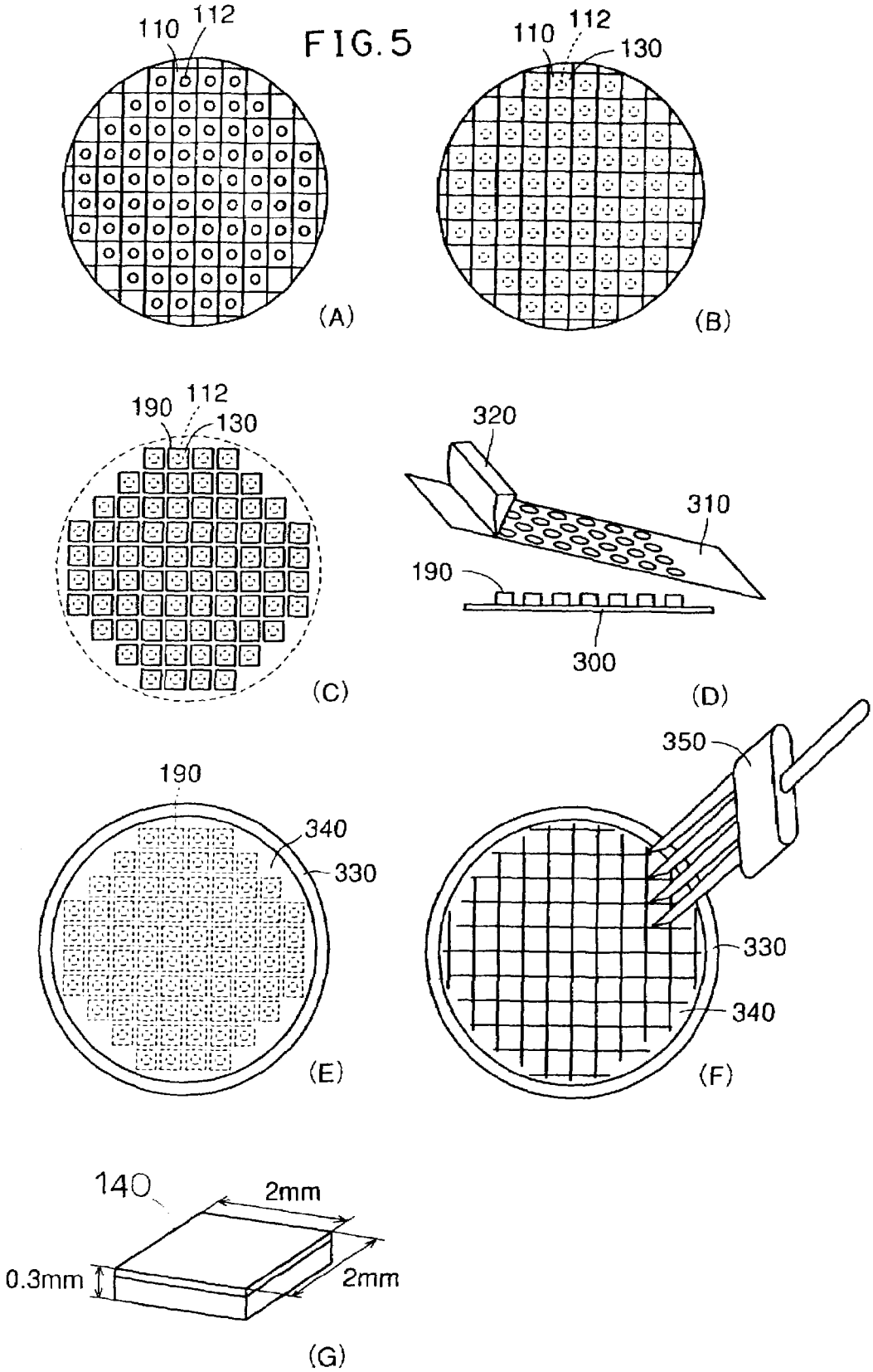
FIG. 5 is a schematic explanatory diagram showing another embodiment for a manufacturing method of an acoustic sensor of the invention.
Figure 6:
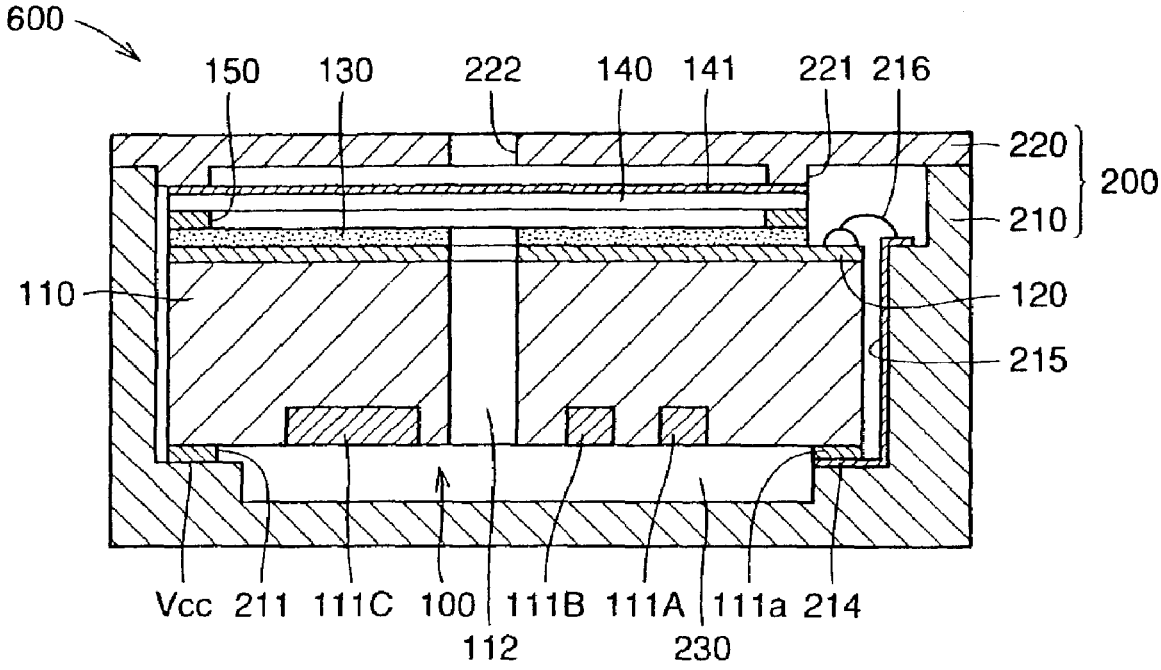
FIG. 6 is a schematic sectional view for an embodiment of a semiconductor electret condenser microphone of the invention.
Figure 7:
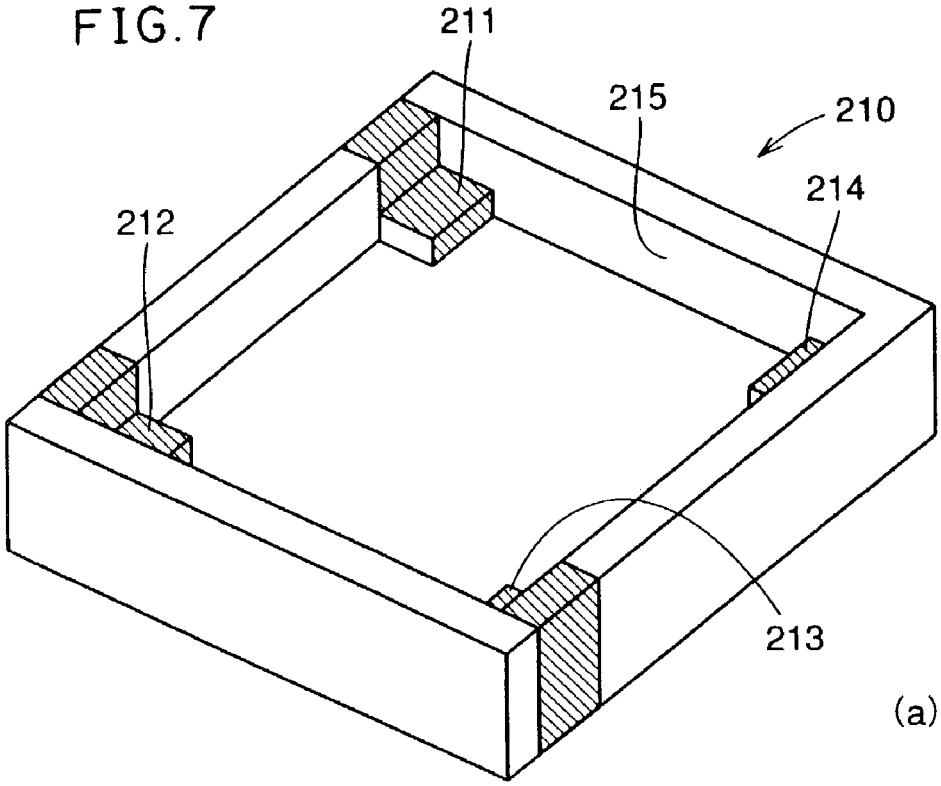
FIG. 7 is a drawing of the case main body of the case used in the semiconductor electret condenser microphone in the embodiment of the invention, (A) being a schematic perspective view from the front side and (B) being a schematic perspective view from the bottom side.
Figure 7:
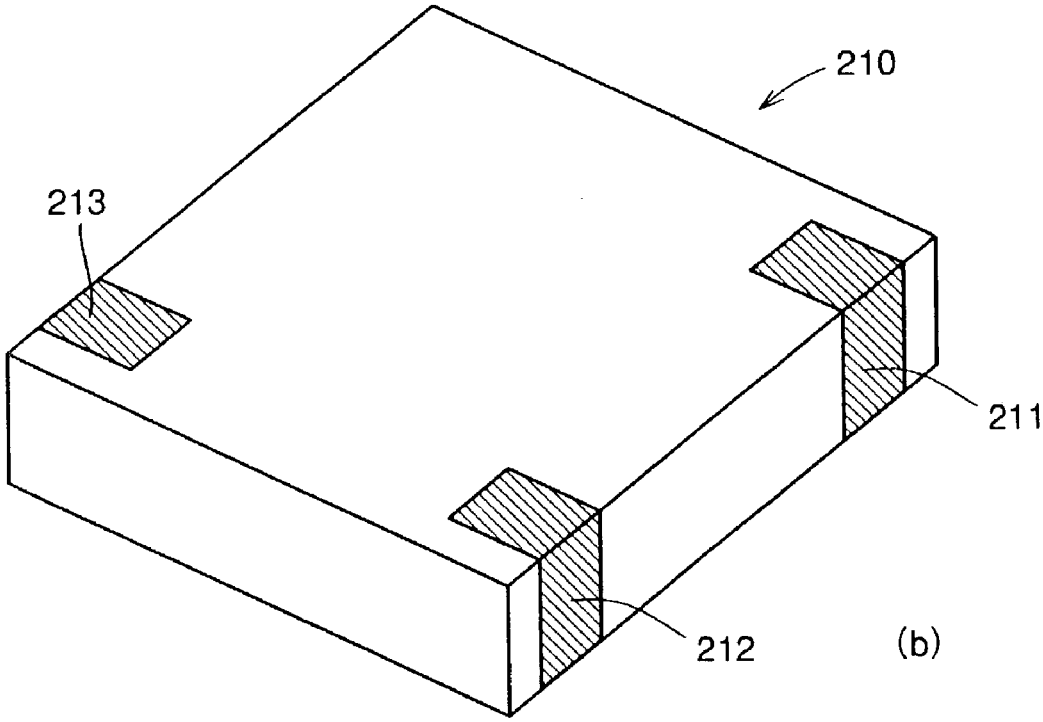

Each acoustic sensor 110 is set in a width of 2 mm, depth of 2 mm, and thickness of 0.3 mm approximately as shown in FIG. 5 (G).

From the back side of the wafer 500 forming a plurality of through holes 112, necessary electronic circuits, such as FET circuit 111A, response gain control circuit 111B, and amplifying circuit 111C, by known photolithography (see FIG. 2 (A)). These circuits 111A to 111C, and the wiring (not shown) for connecting among the circuits 111A to 111C are formed away from the through holes 112.

Figure 3:
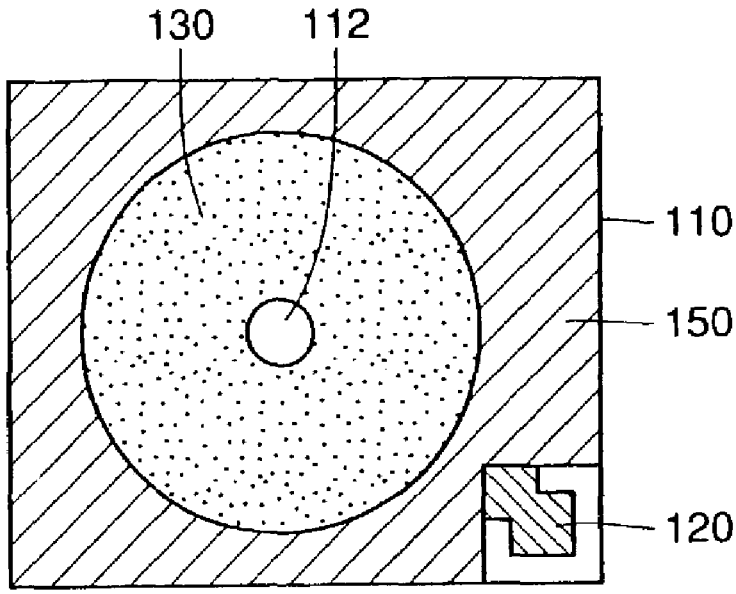
FIG. 3 is a drawing in the midst of manufacturing of an acoustic sensor in the embodiment of the invention, (A) being a schematic plan view and (B) being a schematic bottom view.
Figure 3:
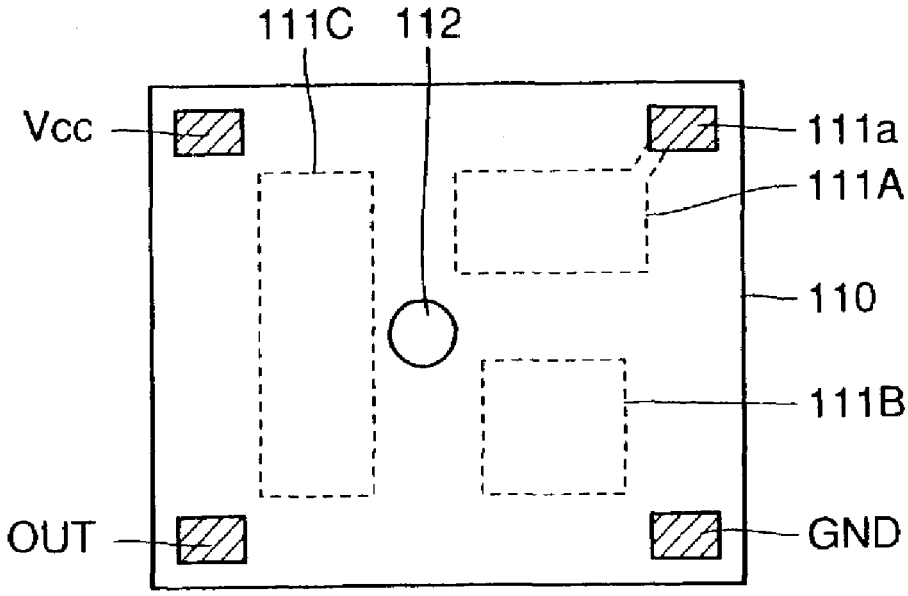

Besides, as shown in FIG. 3 (B), the electrodes of the circuits 111A to 111C, that is, power source electrode Vcc, output electrode OUT, earth electrode GND, and gate electrode 111*a* are preferred to be formed one each at four corners of the back side of each acoustic sensor 100.

On the surface of the wafer 500, consequently, an electrode layer 120 made of aluminum is formed away from the through holes 112 (see FIG. 2 (B)). This electrode layer 120 is the portion connected to the gate electrode 111*a* through a case 200 in a semiconductor electret condenser microphone 600 discussed hereafter. This electrode layer 120 is formed away from the through holes 112 so as not to plug the through holes 112.

On the electrode layer 120, an electret film 130 is laminated (see FIG. 2 (C)). Therefore, this electret film 130 is electrically connected to the electrode layer 120. This electret film 130 is, for example, made of SiO2 of 2 to 3 μm in thickness formed by plasma CVD or high frequency magnetron sputtering, or a thin film of 10 μm or less in thickness obtained by applying an FEP solvent by spin-on-coat method.

The electret film 130 is also formed away from the through holes 112 so as not to plug the through holes 112. The electret film 130 is also formed away from the corresponding corner straightly above the gate electrode 111*a* formed on the backside. Therefore, the electrode layer 120 is exposed from the electret film 130 in the corner straightly above the gate electrode 111*a*.

A spacer 150 is formed on the electret film 130. This spacer 150 is to form a specific interval 160 between the electret film 130 and a diaphragm 140 described below, and it is formed by photo resist. This spacer 150 is formed, as shown in FIG. 3 (A), away from the inside of a circle of 1.5 mm in diameter around the through hole 112, and the corresponding corner straightly above the electrode layer 111*a* formed on the back side. Therefore, the electrode layer 120 is exposed not only from the electret film 130 but also from the spacer 150, as shown in FIG. 3 (A), in the corner straightly above the gate electrode 111*a*.

On thus formed spacer 150, the diaphragm 140 is provided. The diaphragm 140 is a PPS film having an electrode 141 by Ni vapor deposition formed on one side. The diaphragm 140 is disposed on the spacer 150 so that the electrode 141 comes to the surface. Hence, between the diaphragm 140 and the electret film 130, an interval 160 corresponding to the thickness dimension of the spacer 150 is formed.

Further, the wafer 500 is diced into individual acoustic sensors 100.

For this embodiment of the manufacturing method the through holes 112 are opened simultaneously when forming the circuits 111A to 111C, but the step of opening the through holes 112 may also be next to the step of laminating the spacer 150 on the electret film 130. Such manufacturing method is described below while referring to FIG. 4.

Figure 4:
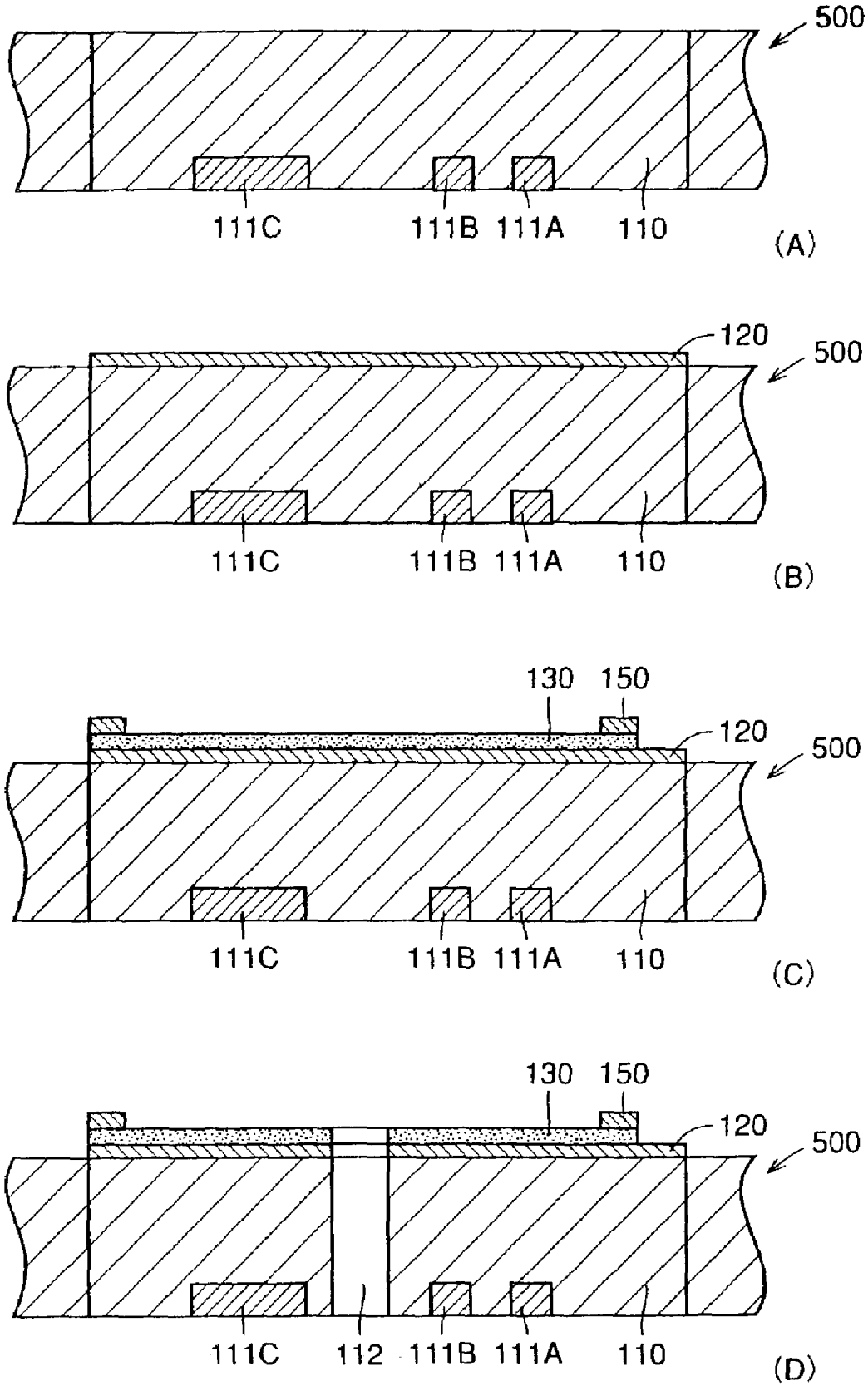
FIG. 4 is a schematic sectional view showing each step of an embodiment for a manufacturing method of acoustic sensor of the invention.

That is, first, from the backside of the wafer 500, circuits 111A to 111C are formed (see FIG. 4 (A)).

Then, on the entire surface of the wafer 500, an electrode layer 120 made of aluminum is formed (see FIG. 4 (B)). On this electrode layer 120, an electret film 130 is laminated (see FIG. 4 (C)).

A spacer 150 is formed on this electret film 130. This spacer 150 is formed away from the inside of a circle of 1.5 mm in diameter around a through hole 112 to be formed in a subsequent step, and the corresponding corner straightly above the gate electrode 111*a* formed on the back side.

After forming the spacer 150, a through hole 112 is formed in the center of one acoustic sensor 100 by ultrasonic processing or laser processing.

The subsequent steps, such as mounting of a diaphragm 140 on the spacer 150 and dicing of the wafer 500 are same as in the manufacturing method mentioned above.

In the foregoing two embodiments, the diaphragm 140 is mounted by adhering a PPS film having an electrode 141 by Ni vapor deposition formed to one side, to the wafer 500. However, the diaphragm 140 may be also formed as shown in FIG. 5.

In this method, before adhering the diaphragm 140, what differs is to divide into individual semiconductor chips 190.

First, in this method, before adhering the diaphragm 140, that is, when forming the spacer 150, it is designed to dice and divide into individual semiconductor chips 190 (see FIG. 5 (C)). Fine dicing dust formed by dicing is cleaned away in a cleaning step.

Consequently, the individual semiconductor chips 190 are adhered on a tacky film 300 with the spacer 150 directed upward, and an adhesive is applied to the spacer 150 by a squeegee 320 through a mask 310 (see FIG. 5 (D)). Further, a film mounted on a ring-shaped jig 330, that is, a PPS film 340 having an electrode by Ni vapor deposition formed on the surface is adhered to the individual semiconductor chips 190 (see FIG. 5 (E)). Later, the PBS film 340 is cut by a cutter 350 (see FIG. 5 (F)), and diaphragms 140 adhered to the individual semiconductor chips 190 are obtained (see FIG. 5 (G)).

Alternatively, in a manufacturing method of dividing into individual semiconductor chips 190 before adhering the diaphragm 140, it is possible to open the through holes 112 by ultrasonic processing or laser processing after forming the spacer 150.

A semiconductor electret condenser microphone 600 using thus composed acoustic sensor 100 is described below.

This semiconductor electret condenser microphone 600 includes the acoustic sensor 100, and a case 200 for accommodating this acoustic sensor 100, and the electrode layer 120 exposed from the electret film 130 is connected to the gate electrode 111*a* of the FET circuit 111A through the case 200, and the through hole 112 communicates with a back chamber 230 formed in the case 200.

The case 200 includes a case main body 210, and a lid 220 fitted to the case main body 210.

The case main body 210 is a thin dish type alumina package of a square shape in a plan view, and at four corners of inside, a projecting earth terminal 211, an output terminal 212, a power source terminal 213, and a gate terminal 214 are formed. The earth terminal 211 is the portion connected to the earth electrode GND of the acoustic sensor 100, the output terminal 212 to the output electrode OUT of the acoustic sensor 100, the power source terminal 213 to the power source electrode Vcc of the acoustic sensor 100, and the gate terminal 214 to the gate electrode 111*a* of the acoustic sensor 100.

When the acoustic sensor 100 is put in this case main body 210, the acoustic sensor 100 has the electrodes 111*a*, Vcc, OUT, and GND mounted on the terminals 211, 212, 213, and 214 as mentioned above. Therefore, between the bottom of the acoustic sensor 100 and the bottom of the case main body 210, a space is formed as the back chamber 230.

Further, inside of this case main body 210, a conductive layer 215 is formed. This conductive layer 215 is the portion for connecting the electrode layer 120 of the acoustic sensor 100 and the gate electrode 111*a*, and it is connected to the gate terminal 214. The conductive layer 215 is connected to the electrode layer 120 through a bonding wire 216.

On the other hand, at the back side of the lid 220, a bump 221 contacting with the edge of the diaphragm 140 of the acoustic sensor 100 is formed. Therefore, when this lid 220 is fitted to the case main body 210 accommodating the acoustic sensor 100, a space is formed between the diaphragm 140 and the lid 220. In the center of the lid 220, a sound hole 222 is opened. The sound wave is transmitted to the diaphragm 140 through this sound hole 222.

By the vibration of the diaphragm 140, the volume varies in the interval 160 between the electret film 130 and the diaphragm 140. This volume change produces a change in the electrostatic capacity of the capacitor composed of the electret film 130 and electrode 141 of the diaphragm 140, and a voltage change is produced as a result.

The output voltage is put into the gate electrode 111*a* of the acoustic sensor 100 through the bonding wire 216, conductive layer 215, and gate terminal 214, and is delivered from the output electrode OUT through the FET circuit 111A, etc.

The acoustic sensor 100 can be used in the semiconductor electret condenser microphone 600, but of course it can be also applied as a pressure sensor or acceleration sensor.

In this manufacturing method of acoustic sensor, in the semiconductor chip 110, through holes 112 are opened away from the electronic circuits, that is, the circuits 111A to 111C, but the through holes 112 may not be formed as explained below.

Figure 9:
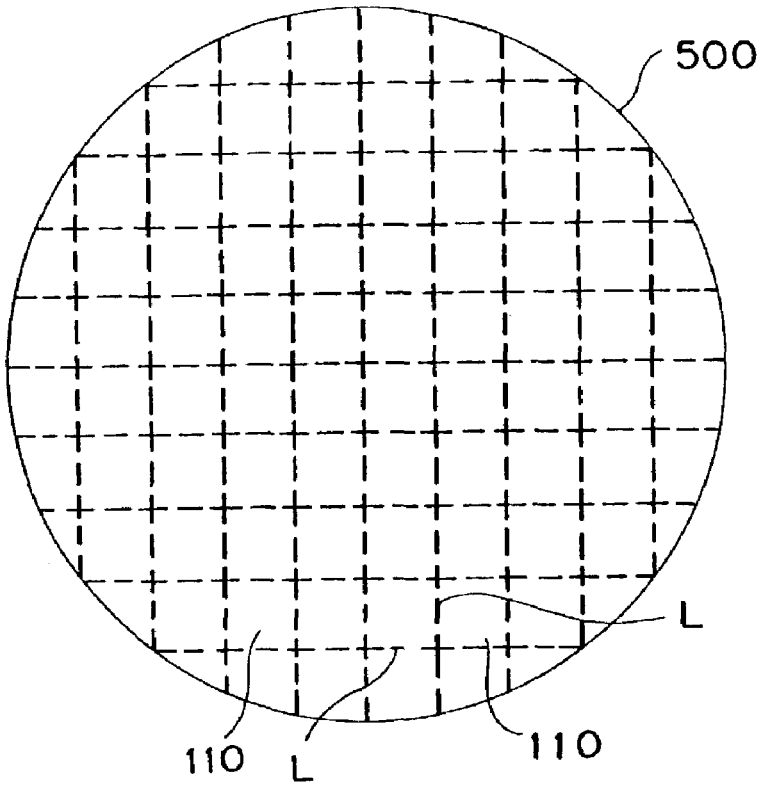
FIG. 9 is a schematic plan view and partially magnified view showing a manufacturing method of acoustic sensor in a different embodiment of the invention.
Figure 9:
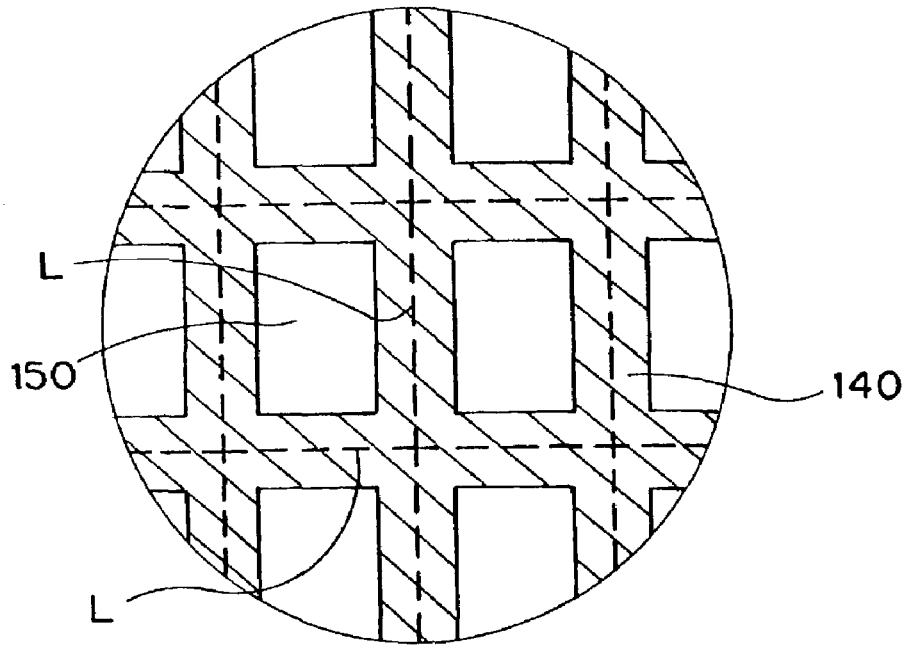

As shown in FIG. 9, a semiconductor chip 110 is formed on a wafer 500. Consequently, on the entire surface of the wafer 500, an electrode layer 120 is formed by plating or vapor deposition. Thereon, SiO2 or FEP is directly formed by a known film forming method such as spinner coating resistance heating vapor deposition, EB vapor deposition, sputtering, and CVD, and a thin film of about 2 μm in thickness is formed. This thin film is an electret film 130. Further thereon, a spacer 150 is formed on each semiconductor chip 110 by screen printing with a screen printing agent including an adhesive. The spacer 150 is formed in a thickness of about 5 to 30 μm. A diaphragm 140 is adhered further thereon.

Figure 10:
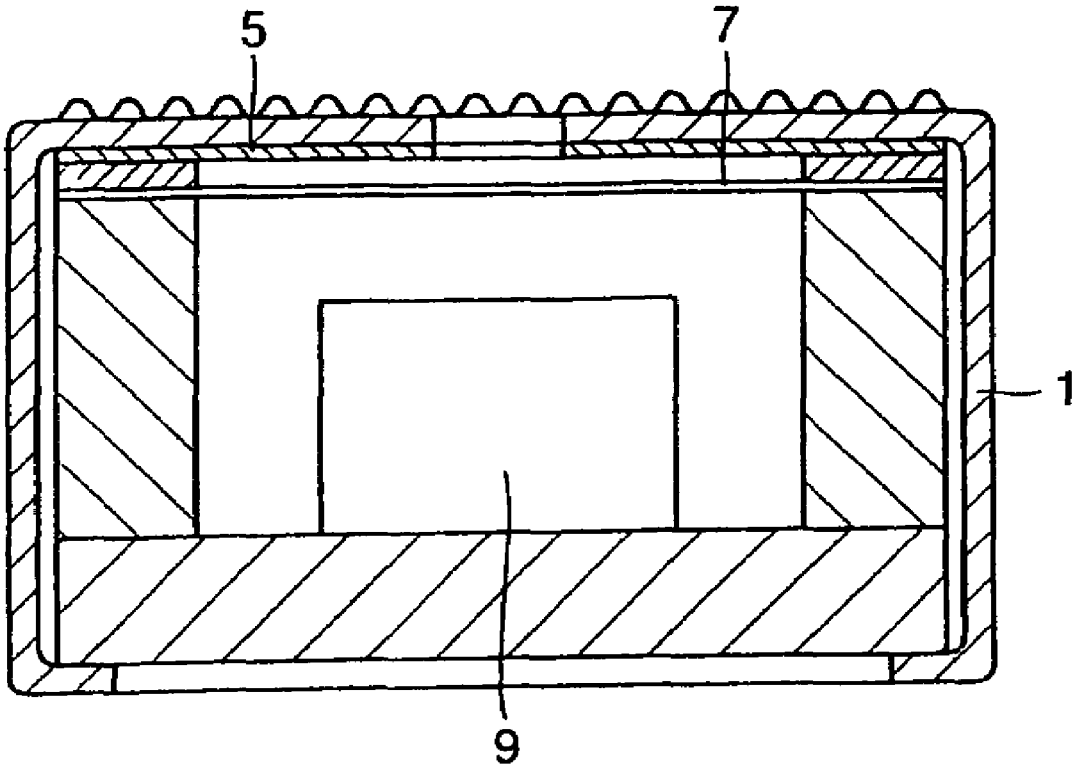
FIG. 10 (PRIOR ART)
FIG. 10 illustrates an example of a known electret condenser microphone.

After adhesion of the diaphragm 140, the wafer 500 is cut along the cutting line L shown in FIG. 10 (the central area of screen printing) and divided into semiconductor chips 110, together with the parts formed on the surface. As a result, an acoustic sensor 100 is manufactured, and by putting the manufactured acoustic sensor 100 into the case 200 of ceramic package, so that a condenser microphone of back electret type is completed.

Figure 8:
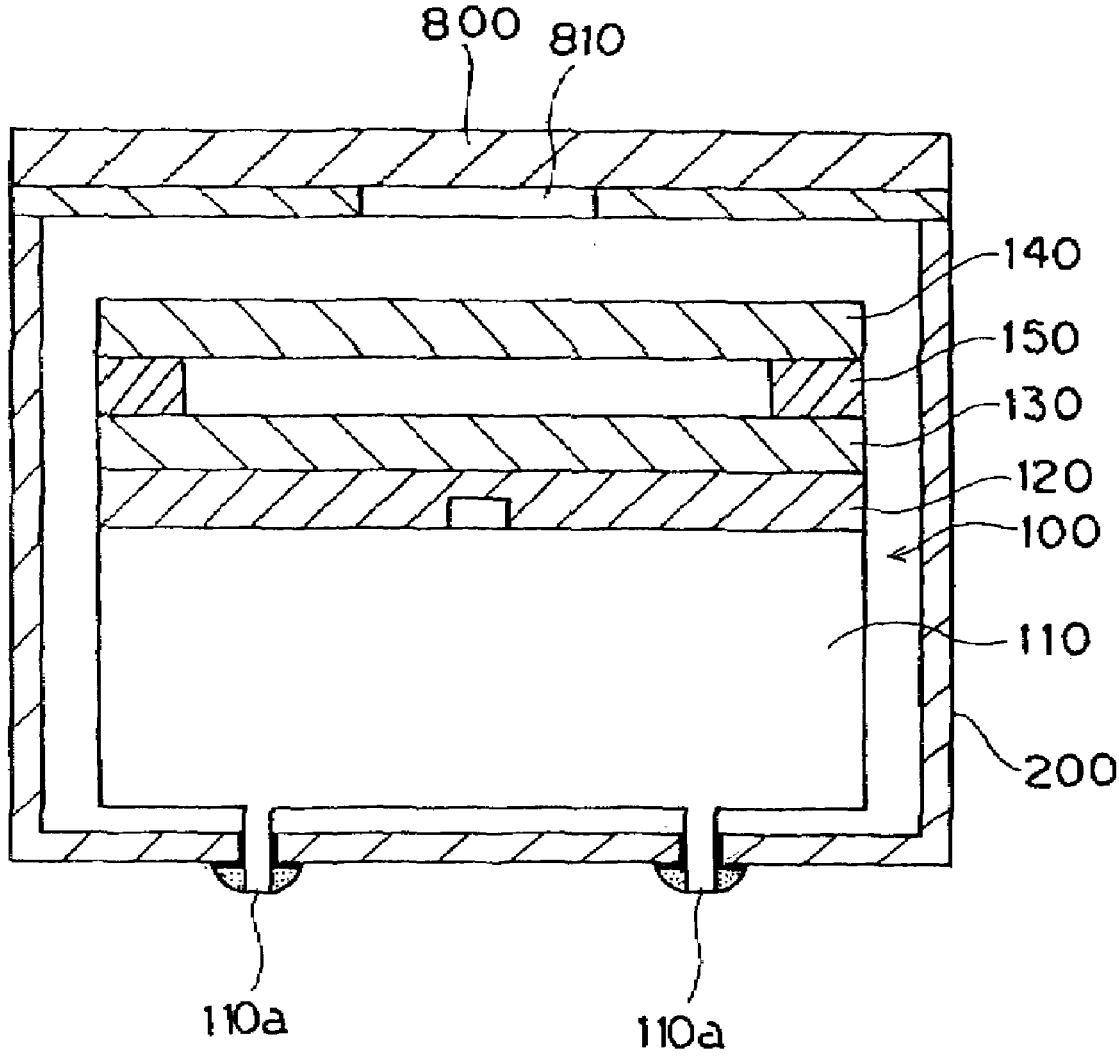
FIG. 8 is a schematic sectional view of semiconductor electret condenser microphone in a different embodiment of the invention.

In FIG. 8, meanwhile, reference numeral 111*a* is a terminal, 800 is a front cloth, and 810 is a sound hole.

This electret condenser microphone features the following points as compared with the conventional electret condenser microphone.

The acoustic sensor 100 is assembled in one chip including electronic circuits, and it is very small and is easy to assemble. By using the wafer, the acoustic sensor can be manufactured efficiently.

Since the electret film 130 is formed on the surface of the electrode layer 120 as back electrode by forming a film directly, the electret film 130 is free from distortion or mechanical stress. Hence, lowering of performance due to mechanical stress of the electret film 130 is avoided, and its performance is enhanced.

Incidentally, in the cases of a conventional condenser microphone by forming the electret film by fusion of high molecular film, distortion of the electret film 130 is inevitable, and the mechanical stress due to this distortion has caused to lower the performance.

Also because the thickness of the electret film 130 is reduced to about 2 μm, the performance of the microphone is enhanced. The reason is explained as follows.

The output e of the capacitor composed of the diaphragm and electret film is expressed in formula 1. In formula 1, k is a constant, C1 is a capacity of the space formed between the diaphragm and electret film, C2 is a capacity of the electret film, ΔC1 is a capacity change of the space when a sound pressure is applied.

$$e=k\cdot[\Delta C1/(C1+C2)]\cdot\sin(\omega t+\phi) \quad (1)$$

In the case of the conventional condenser microphone using a high molecular film as electret film, the thickness of the space (the thickness of the spacer) is about 30 μm, and the thickness of the high molecular film is 12.5 to 25 μm. When the capacity of the space is equal to the capacity of the high molecular film, the output e1 of the capacity is expressed in formula 2.

$$e1\approx k\cdot(1/2)\cdot(\Delta C1/C1)\cdot\sin(\omega t+\phi) \quad (2)$$

On the other hand, when the electret film is formed by a film directly on the surface of the electrode surface, and when the thickness is reduced to about 1 micron, C2 can be nearly 0, and the output e of the capacitor is expressed in formula 3.

$$e2\approx k\cdot(\Delta C1/C1)\cdot\sin(\omega t+\phi) \quad (3)$$

In comparing formula 2 and formula 3, one skilled in the art can appreciate that when a thin electret film is formed by a film directly on the surface of the electrode layer, a double output is obtained, and the sensitivity is enhanced by 6 dB. That is, a semi-condenser type microphone is obtained, and the sensitivity is enhanced substantially.

When the spacer 150 is formed by screen printing, the productivity is enhanced. Incidentally, in the conventional condenser microphone, the spacer formed by blanking a high molecular film was used, but blanking burrs and wrong number of inserted pieces occur often, and the mass producibility was low. By forming the spacer 150 by screen printing, such problems have been solved.

The acoustic sensor of the invention includes a semiconductor chip forming a necessary electronic circuit, an electrode layer formed on the surface of this semiconductor chip, an electret film laminated away from part of this electrode layer, and a diaphragm disposed with a spacing to this electret film.

In such acoustic sensor, the electronic circuit necessary for amplifying or the like is formed integrally with the electret film and others, and by using it, therefore, the semiconductor electret condenser microphone smaller in size and more advanced in function than in the prior art will be obtained.

The manufacturing method of acoustic sensor of the invention includes a step of forming a necessary electronic circuit on a wafer, a step of forming an electrode layer on the wafer surface, a step of laminating an electret film away from part of the electrode layer, a step of laminating a spacer on the electret film, a step of forming a diaphragm with a spacing to the electret film on the spacer, and a step of dividing into individual sensors.

According to this manufacturing method, the acoustic sensor as mentioned above will be obtained.

Other manufacturing method of acoustic sensor of the invention includes a step of forming a necessary electronic circuit on a wafer, a step of forming an electrode layer on the wafer surface, a step of laminating an electret film away from part of the electrode layer, a step of laminating a spacer on the electret film, a step of dicing the wafer to form individual semiconductor chips, a step of cleaning the individual semiconductor chips, a step of arranging the cleaned individual semiconductor chips with the spacer positioned at the upper side, a step of applying an adhesive to the spacer of the arranged individual semiconductor chips, a step of adhering a film to the spacer of the individual semiconductor chips as a diaphragm by using the adhesive, and a step of cutting the film to form diaphragms.

This manufacturing method is free from breakage of the diaphragm or attenuation of electret film due to washing by purified water after dicing, so that a more favorable acoustic sensor may be manufactured.

In the manufacturing method of opening the through holes after forming the spacer, it is not necessary to avoid the through holes when forming the electrode layer and electret film, and it is possible to form on the entire surface, so that the manufacturing process is much simplified.

The semiconductor electret condenser microphone of the invention includes the acoustic sensor, and a case for accommodating this acoustic sensor, in which the electrode layer exposed from the electret film is connected to the electrode of the electronic circuit through the case.

Therefore, in this semiconductor electret condenser microphone, by using this acoustic sensor, the size is smaller and the function is more advanced than in the prior art.

Further, as the necessary electronic circuits, by forming the FET, amplifier and/or noise canceling circuit, a more excellent electret condenser microphone is realized.

The invention claimed is:

1. A manufacturing method of acoustic sensor comprising a step of forming a necessary electronic circuit on a wafer, a step of forming an electrode layer on the wafer surface, a step of laminating an electret film away from part of said electrode layer, a step of laminating a spacer on said electret film, followed by a step of opening a through hole penetrating through the wafer, electrode layer and electret film away from said electronic circuit, a step of forming a diaphragm with a spacing to said electret film on said spacer, and a step of dividing into individual sensors.

2. The manufacturing method of acoustic sensor of claim 1, wherein said electronic circuit is FET, amplifier circuit and/or noise canceling circuit.

* * * * *